US006210213B1

(12) United States Patent
Stekelenburg

(10) Patent No.: US 6,210,213 B1
(45) Date of Patent: Apr. 3, 2001

(54) CARRIER FOR ELECTRICAL SOCKET/ PLUG

(76) Inventor: Albert Stekelenburg, 9th Fl., Kuang-Fu S. Rd., Taipei (TW)

( * ) Notice: Subject to any disclaimer, the term of this patent is extended or adjusted under 35 U.S.C. 154(b) by 0 days.

(21) Appl. No.: 09/343,196

(22) Filed: Jun. 30, 1999

(51) Int. Cl.[7] ..... H01R 13/60
(52) U.S. Cl. ..... 439/528; 439/37
(58) Field of Search ..... 439/37, 35, 40, 439/41, 148, 527, 528

(56) References Cited

U.S. PATENT DOCUMENTS 4,921,444 * 5/1990 Cama ..... 439/528
5,308,253 * 5/1994 Maki ..... 439/148
5,593,170 * 1/1997 Chiu ..... 280/422

* cited by examiner

*Primary Examiner*—Khiem Nguyen
(74) *Attorney, Agent, or Firm*—Dougherty & Troxell

(57) ABSTRACT

A carrier is disclosed for receiving and carrying an electrical connector head, such as a plug or a socket, which may be attached to the worker, such as by attaching it to clothing, a belt, or a work belt, the carrier receiving and carrying the electrical connector head of the electrical cord. The carrier has a sidewall forming a hollow body having an open end and a closed end, with the open end having a larger transverse dimension than the closed end, and an inserting channel through the sidewall extending from the open end into and at least partially across the closed end. A clip extends from the exterior of the sidewall to clip the carrier to the worker, or to an article easily carried by the worker, such as a toolbox, or the like.

3 Claims, 2 Drawing Sheets

CARRIER FOR ELECTRICAL SOCKET/ PLUG

FIELD OF THE INVENTION

The present invention relates to a carrier for receiving and carrying an electrical connector head, such as a plug or a socket, that is attached to an electrical cord. The carrier enables a user to move the electrical connector head as the user moves to various locations in a workplace without the need to move the electrical connector head by hand.

BACKGROUND OF THE INVENTION

In various workplaces, it is often necessary for a worker to move to various locations within the workplace and to utilize electrical power tools in these various locations. It has been necessary in the past for the worker to use electrical extension cords and to physically move the connector head of the extension cord, which may be either a plug or a socket, by hand to the various workplace locations. This has proven to be inefficient, and possibly dangerous, in locations in which the worker must climb or descend a ladder while at the same time holding the end of the extension cord. It has also proven to be inconvenient where the worker must also carry other articles, such as power tools, tool boxes, or the like.

SUMMARY OF THE INVENTION

The present invention provides a carrier for receiving and carrying an electrical connector head, such as a plug or a socket, which may be attached to the worker, such as by attaching it to clothing, a belt, or a work belt, the carrier receiving and carrying the electrical connector head of the electrical cord. The carrier has a sidewall forming a hollow body having an open end and a closed end, with the open end having a larger transverse dimension than the closed end, and an inserting channel through the sidewall extending from the open end into and at least partially across the closed end. A clip extends from the exterior of the sidewall to clip the carrier to the worker, or to an article easily carried by the worker, such as a toolbox, or the like.

The connector head is inserted into the hollow body by inserting the electrical cord through the inserting channel and placing the electrical connector head within the hollow body. The electrical cord then extends through the portion of the inserting channel located in the closed end. Once the carrier is attached to the worker, the worker can easily move to various locations in the workplace without manually manipulating the connector head or the electrical cord.

DETAILED DESCRIPTION OF THE PREFERRED EMBODIMENT OF THE INVENTION

Figure 1:
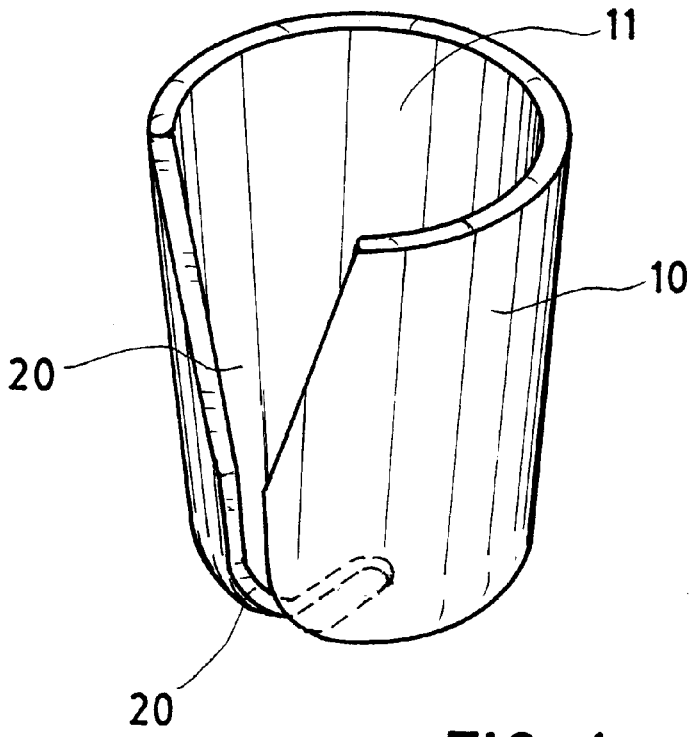
FIG. 1 is a perspective view of a carrier according to the present invention illustrating the inserting channel.
Figure 2:
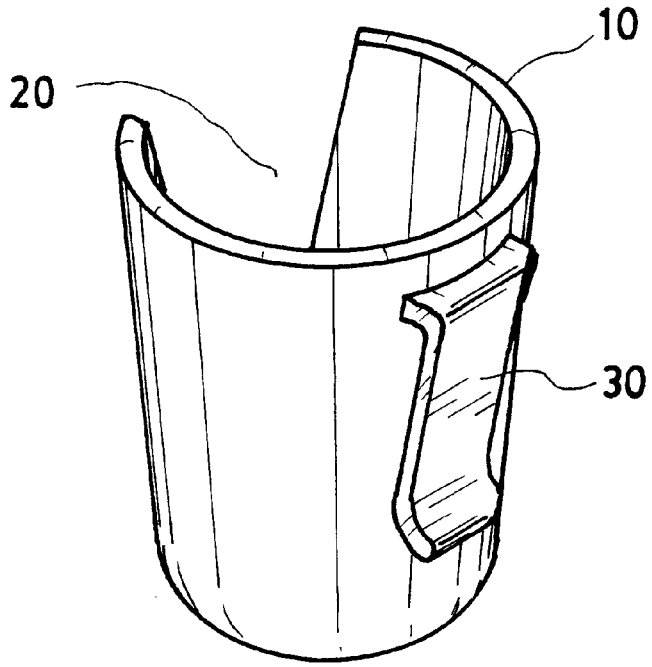
FIG. 2 is a perspective view of the carrier of FIG. 1 illustrating the attaching clip.

FIGS. 1 and 2 show perspective views of the carrier according to the present invention which includes a hollow body (10) having an open end (11) and a closed end. The hollow body (10) has a generally cup-shaped body and is configured to receive an electrical connector head therein, the connector head comprising a plug or a socket. The hollow body (10) has a generally tapered configuration with the open end (11) having a larger transverse dimension than the closed end. This enables various configurations of electrical connector heads to be securely retained within the hollow body.

An inserting channel (20) extends through the sidewall and extends from the open end (11) into and at least partially across the closed end. As best illustrated in FIG. 1, the inserting channel (20) has a tapered configuration with the widest portion of the tapered configuration located at the open end (11). The tapered configuration enables the electrical cord (41) attached to the connector head (40) to be readily inserted into the inserting channel (20). The end of the inserting channel located in the closed end of the hollow body (10) may have a semicircular configuration to accommodate the generally circular cross-sectional configuration of the electrical cord (41). The tapered portion of the inserting channel (20) may extend for approximately half the length of the hollow body (10).

Figure 3:
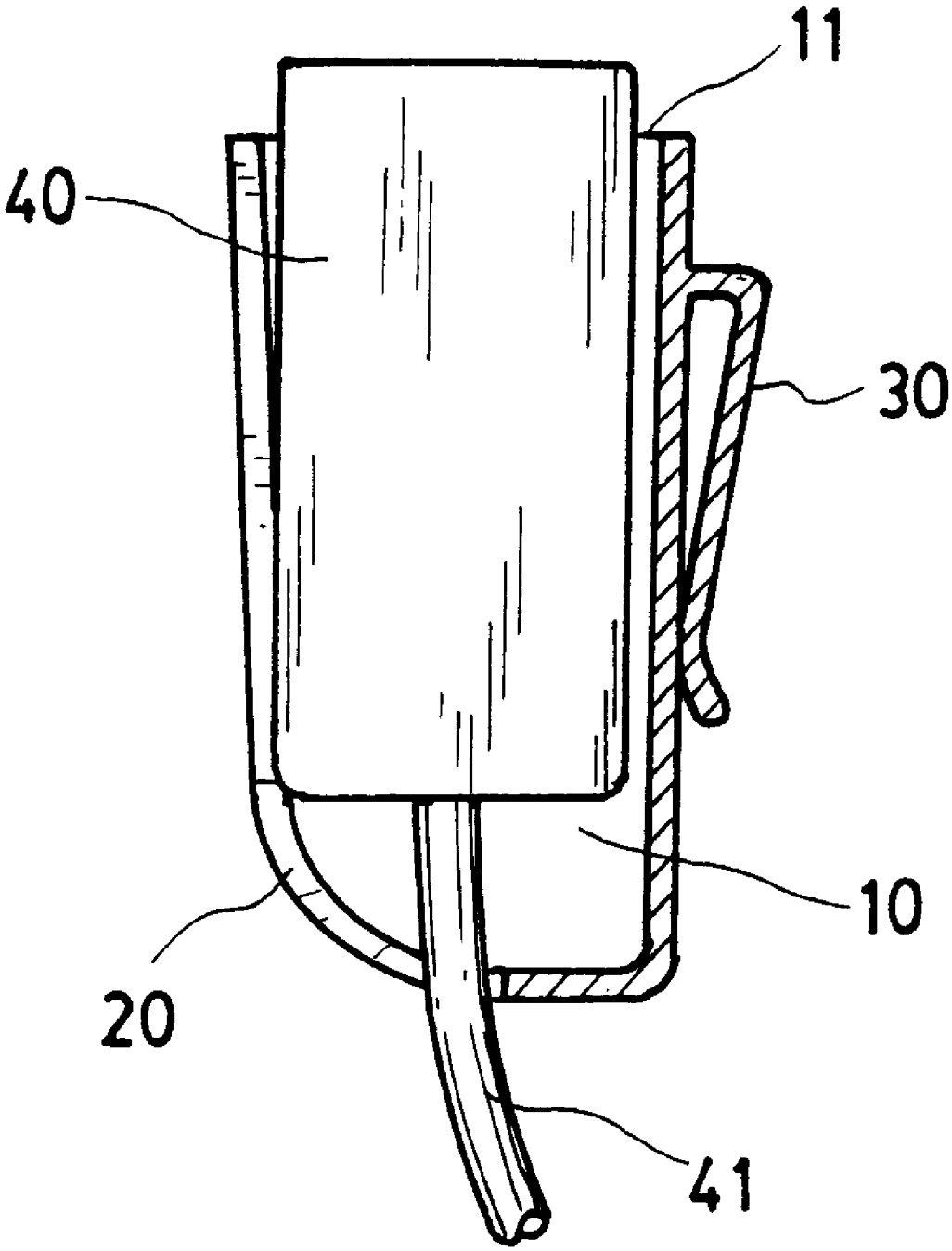
FIG. 3 is a cross-sectional view of the carrier according to the present invention with an electrical connector head inserted therein.

An attaching clip (30) extends outwardly from an exterior surface of the hollow body (10) and comprises a resilient material to enable the carrier to be clipped onto various items carried by the worker, such as a belt, work belt, toolbox, etc. As seen in FIGS. 2 and 3, the attaching clip (30) may be located generally opposite to the inserting channel (20).

The electrical connector head (40) attached to electrical cord (41) may be inserted into the carrier by moving the electrical cord (41) laterally through the inserting channel (20) such that the connector head (40) is located above the open end (11) of the hollow body and subsequently pushing the connector head (40) down into the hollow body (10). The electrical cord (41) will extend through the portion of the inserting channel (20) located in the closed end of the hollow body. This may be accomplished either before or after the carrier has been attached to an article worn by, or carried by, the worker. Once attached, the worker can readily move to various locations within the workplace without the necessity of manually manipulating the connector head or the electrical cord. The worker may readily connect various electrically powered tools to the connector head (40) while moving about the workplace.

By utilizing the carrier according to the present invention, the worker can ascend or descend ladders or steps having the security of using both hands on the ladder or handrail, while at the same time, carrying the connector head and moving the electrical cord to the new location.

The foregoing description is provided for illustrative purposes only and should not be construed as in any way limiting this invention, the scope of which is defined solely by the appended claims.

What is claimed is:

1. A carrier for receiving and carrying an electrical connector head, such as a plug or socket, attached to an electrical cord, the carrier comprising:

a) a sidewall forming a hollow body having an open end and a closed end, the open end having a larger transverse dimension than the closed end;

b) an inserting channel through the sidewall extending from the open end into and at least partially across the closed end wherein a portion of the inserting channel adjacent to the open end of the hollow body has a tapered configuration with a widest portion of the tapered configuration located at the open end; and, c) an attaching clip extending from an exterior of the sidewall wherein the attaching clip extends from the sidewall at a location generally opposite to the inserting channel, whereby the connector head is inserted into the hollow body and supported thereby and the cord extends outwardly through the inserting channel.

2. The carrier according to claim 1 wherein the tapered portion of the inserting channel extends approximately one half of a length of the hollow body.

3. The carrier according to claim 1 wherein an end of the inserting channel in the closed bottom is semi-circular in configuration.

* * * * *